US006868967B2

(12) United States Patent
Lam

(10) Patent No.: US 6,868,967 B2
(45) Date of Patent: Mar. 22, 2005

(54) TOOL BOX

(75) Inventor: Andy Lam, Scarborough (CA)

(73) Assignee: Mibro Partners, Scarborough (CA)

( * ) Notice: Subject to any disclaimer, the term of this patent is extended or adjusted under 35 U.S.C. 154(b) by 15 days.

(21) Appl. No.: 09/968,619

(22) Filed: Oct. 2, 2001

(65) Prior Publication Data

US 2003/0062279 A1 Apr. 3, 2003

(51) Int. Cl.[7] ..... A45C 11/26; B65D 85/28

(52) U.S. Cl. ..... 206/350; 206/372; 206/373; 206/818

(58) Field of Search ..... 206/350, 372, 206/373–379, 818, 558, 561, 231, 234; 312/902; 211/70.6, DIG. 1; 220/230, 23.83, 23.88, 528, 527, 23.2, 23.4; 190/16, 110

(56) References Cited

U.S. PATENT DOCUMENTS

| | | | | | |
|---|---|---|---|---|---|
| 3,197,915 | A | | 8/1965 | Staver | |
| 3,726,393 | A | | 4/1973 | Thompson | |
| 4,020,584 | A | | 5/1977 | Michal | |
| 4,279,354 | A | * | 7/1981 | Conti | 220/23.83 |
| 4,482,049 | A | | 11/1984 | Kot, II | |
| 4,611,716 | A | * | 9/1986 | Sorlien | 206/806 |
| 4,697,379 | A | | 10/1987 | McPhaul | |
| 4,930,628 | A | * | 6/1990 | Bridges | 206/373 |
| 5,005,697 | A | * | 4/1991 | Jimbo et al. | 206/818 |
| 5,351,812 | A | * | 10/1994 | Eagon | 206/818 |
| 5,405,004 | A | * | 4/1995 | Vest et al. | 206/350 |
| 5,526,927 | A | * | 6/1996 | McLemore | 206/818 |
| 5,660,276 | A | | 8/1997 | Winnard | |
| 5,680,932 | A | * | 10/1997 | Dickinson et al. | 206/372 |
| 5,725,096 | A | | 3/1998 | Winnard | |
| 5,826,718 | A | * | 10/1998 | Ahern et al. | 206/372 |
| 5,887,715 | A | | 3/1999 | Vasudeva | |
| 6,044,973 | A | | 4/2000 | Vasudeva | |
| 6,073,766 | A | | 6/2000 | Winnard | |
| 6,237,767 | B1 | | 5/2001 | Lee | |
| 6,267,277 | B1 | * | 7/2001 | Taylor | 206/350 |
| 6,322,177 | B1 | | 11/2001 | Vasudeva | |

* cited by examiner

*Primary Examiner*—Mickey Yu
*Assistant Examiner*—J. Gregory Pickett
(74) *Attorney, Agent, or Firm*—Nancy E. Hill; Hill & Schumacher

(57) ABSTRACT

A tool box is for holding a plurality of tools and tool parts. The tool box includes a base, a lid and at least one tray. The base has at least one row. The lid is attached to the base. Each tray has at least one receiving device adapted to receive one of a predetermined tool and tool part. Each tray is releaseably attachable in a row and includes a magnetic method of holding the tray in the row. The tool box may include a plurality of rows. The magnetic holding method may include a metal strip attached to the bottom of each row and a plurality of magnets attached to the bottom of each tray.

11 Claims, 5 Drawing Sheets

TOOL BOX

FIELD OF THE INVENTION

This invention relates to tool boxes and in particular tool boxes adapted to store a plurality of different tools and parts thereof.

BACKGROUND OF THE INVENTION

Tool boxes are likely almost as old as tools themselves. Tool boxes come in a wide variety of shapes and sizes. Some tool boxes are single function tool boxes that are designed to hold a particular tool, for example a drill or a hand saw. Others are designed to hold a plurality of one type of tool part. Still others are designed to hold a plurality of different tools and/or tool parts.

Typically the tool boxes designed to hold a plurality of different tools and tool parts try to maximize the number of tools in a predetermined space. Accordingly, the tools and tool parts are positioned with an eye to space utilization rather than tool functionality. Accordingly the drill bits may be mixed with screwdriver bits and/or sockets. This intermingling of the tool parts often makes the tools and the tool box difficult to use. As well, since the tool parts are arranged as close together as possible they are often difficult to remove and replace. As well, if certain tools are needed for a particular task the user either has to obtain each tool individually or the user has to take the entire tool box to the particular task.

Some tool boxes have been suggested which use magnets to hold the tool or tool parts in position. However, the prior art does not show a tool box that holds tool trays in place with magnets. Further none of the prior art shows a tool box with a plurality of removable tool trays each adapted to hold particular tools or tool parts.

Accordingly it would be advantageous to provide a tool box that is easy to use, versatile and holds a plurality of different types of tools and tool parts. Further it would be advantageous to provide a tool box that has a plurality of different trays, each designed to hold a different set of tools or tool part, that may easily be removed and repositioned in a tool box.

SUMMARY OF THE INVENTION

The present invention is a tool box for holding a plurality of tools and tool parts. The tool box includes a base, a lid and at least one tray. The base has at least one row. The lid is attached to the base. Each tray has at least one receiving device adapted to receive one of a predetermined tool and tool part. Each tray is releaseably attachable in a row and includes a magnetic method of holding the tray in the row. The tool box may include a plurality of rows. The magnetic holding method may include a metal strip attached to the bottom of each row and a plurality of magnets attached to the bottom of each tray.

In another aspect of the invention a tool box is adapted to receive at least one tray having at least one receiving device adapted to receive one of a predetermined tool and tool part. The tool box includes a base and a lid. The base has at least one row adapted to receive a tray. The tool box includes a magnetic method of holding a tray in the row.

In further aspect of the invention a tray is adapted to be positioned in a tool box having a base having at least one row and a lid attachable to the base. The tray includes at least one receiving device adapted to receive one of a predetermined tool and tool part. The tray is releaseably attachable in the row of the tool box and the tray includes a magnetic method of holding the tray in the row.

In a still further aspect of the invention a tool box is for holding a plurality of tools and tool parts. The tool box includes a base, a lid and a plurality of trays. The base has at least one row. The lid is attachable to the base. Each tray has at least one receiving device adapted to receive one of a predetermined tool and tool part. Each tray is releaseably attachable in a row. There is a method of holding each tray in a row.

Further features of the invention will be described or will become apparent in the course of the following detailed description.

BRIEF DESCRIPTION OF THE DRAWINGS

The invention will now be described by way of example only, with reference to the accompanying drawings, in which.

DETAILED DESCRIPTION OF THE INVENTION

Figure 1:
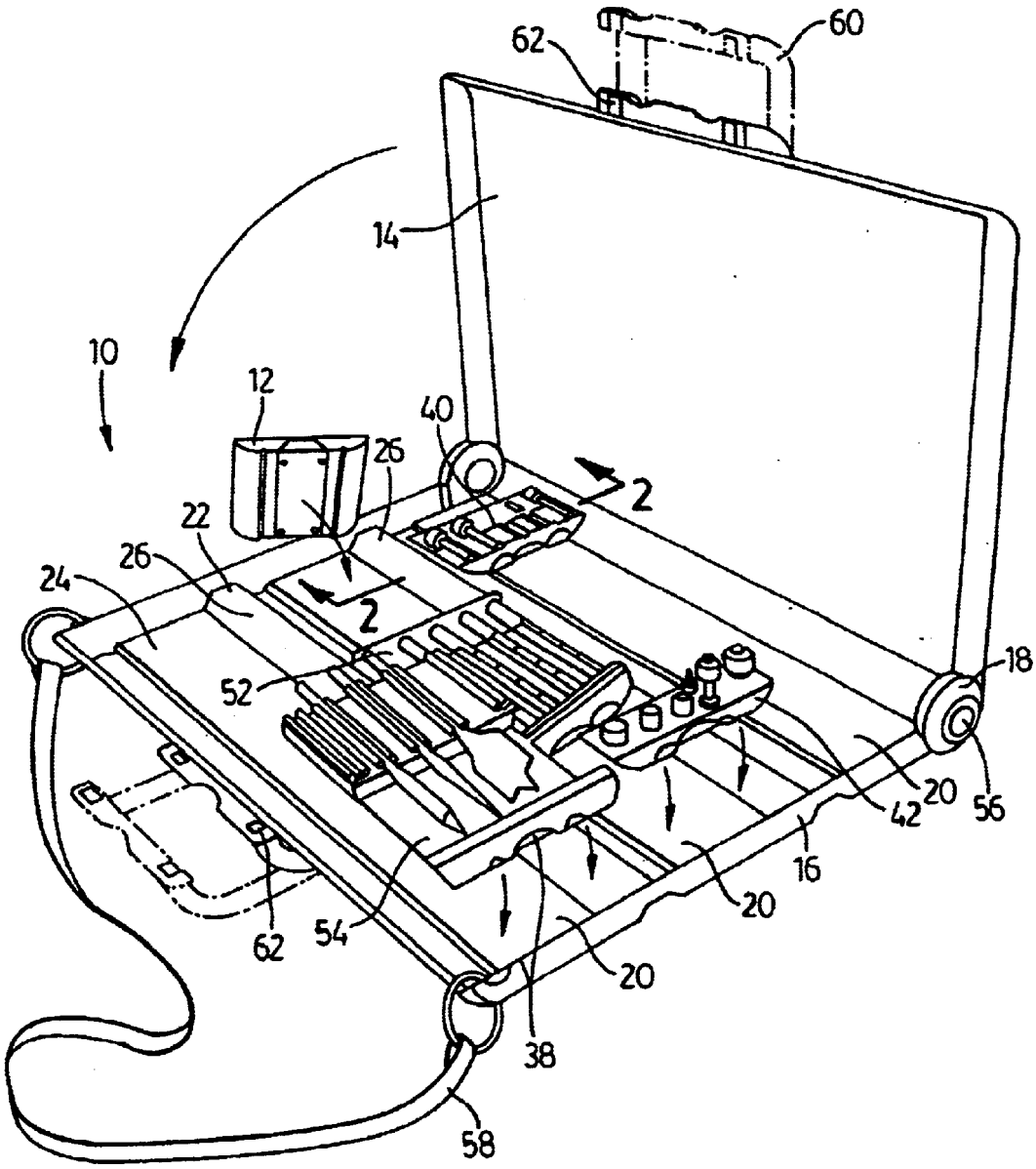
FIG. 1 is a perspective view of the tool box constructed in accordance with the present invention.

Referring to FIG. 1, the tool box of the present invention is shown generally at 10. The tool box 10 holds a plurality of easily removable trays 12.

The tool box has a lid 14 and a base 16 joined by a hinge 18. The base 16 is divided into a plurality of rows 20. Each pair of rows 20 has an elongate ridge 22 therebetween. Each row 20 has a metal portion 24 to which a magnet will attach. Preferably the metal portion 24 is an elongate metal strip which is attached along the bottom of the row 20 and extends along the length thereof. The sides 26 of each row is generally curved inwardly. All of the rows 20 have the same transverse cross section. Preferably lid 14 is transparent. It will be appreciated by those skilled in the art that a wide variety of dimensions may be used for the tool box 10. For example box 10 may be 15 inches long by 12 inches wide by 3 inches deep.

Figure 2:
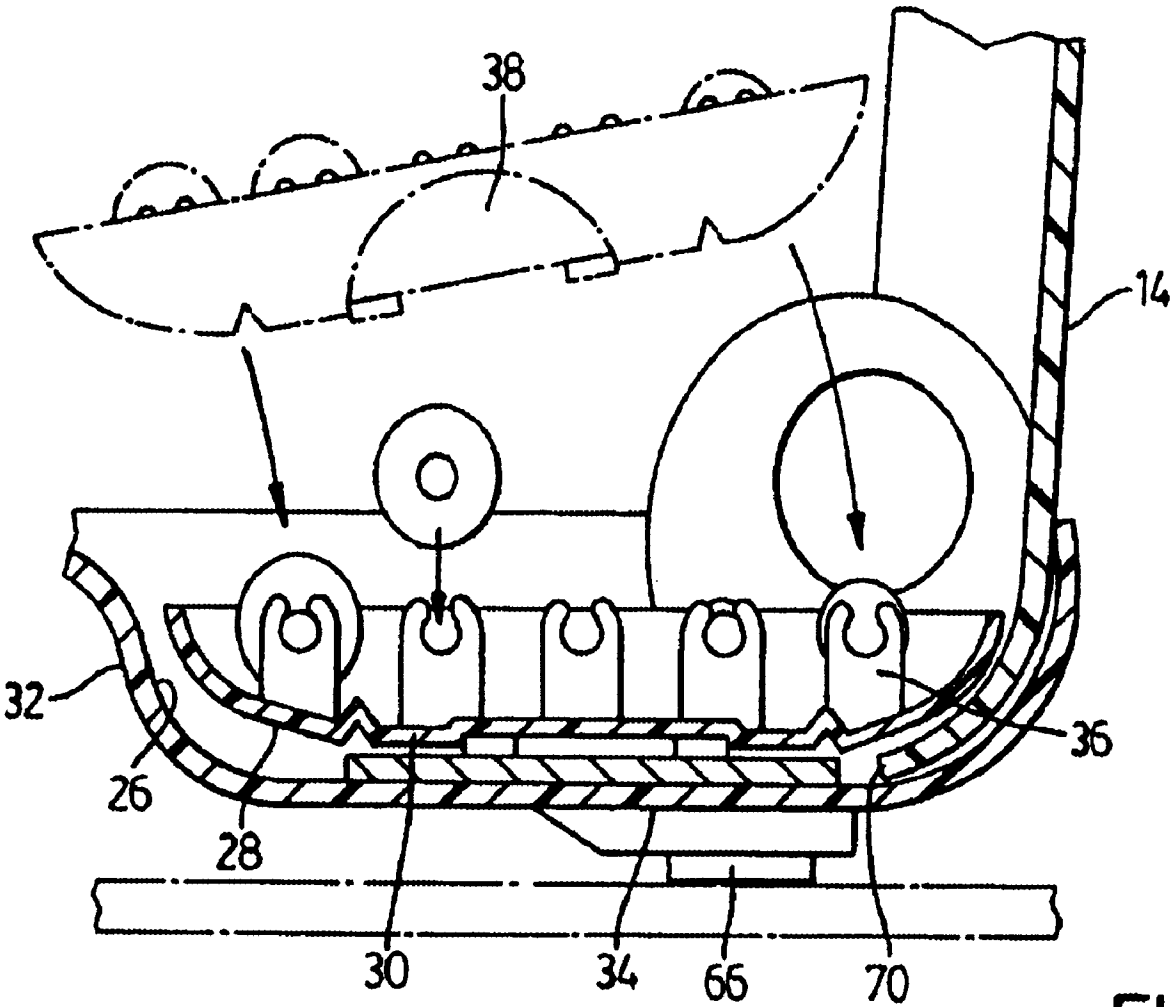
FIG. 2 is an enlarged sectional view taken along line 2—2 in FIG. 1.

Referring to FIG. 2, each tray 12 is adapted to receive a predetermined tool, set of tools or parts thereof. Each tray 12 has a underside 28 shaped to fit into a row 20. The underside 28 has a generally flat bottom portion 30 and curved side portions 32. Attached to the underside 28 is a magnetic portion 34. Preferably magnets 35 are attached to the four corner(s) of the underside 28 of the tray 12. Each tray 12 has at least one receiving device 36 that receives a tool or tool part. Preferably the receiving devices 36 are arranged such that a set of tools or tool parts may be positioned in a predetermined tray. Each tray 12 has a recessed portion 38 on each end thereof. The recessed portion 38 provides a place for the user to grip the tray 12 to easily remove it from the box 10 or place it therein. Each tray 12 is held in place by the force between the magnet portion 34 on the tray 12 and the metal portion 24 in each row 20 of the box 10. Since the side portion 32 of each tray 12 is curved and it mates with the curved side 26 of ridge 22, each tray 12 can easily be positioned in a row 20 of the box 10.

As discussed above, the receiving devices 36 are arranged such that a set of tools or tool parts may be positioned in a tray. For example the following type of trays may be included, some of which are shown in FIGS. 1, 3, 4 and 6; a screwdriver bit tray 40; a socket tray 42; a countersink bit tray (not shown); a hole saw tray 44 (shown in FIG. 6); a hand tool tray 46, an adapter tray 48; a nut setter tray 50; a drill bit tray 52; and a spade bit tray 54. A tray may also be adapted to be a container as shown by large box tray 55 and small box tray 57 in FIG. 6. It will be appreciated by those skilled in the art that this list of trays is by way of example only and that any number of different types of trays could also be used. Trays 12 may also include writing or symbols to indicate which tool or tool part that should be placed in the receiving device 36. Each tray 12 fits into a row 20 and therefore the width of each tray is the same but the length may vary depending on the tool or tool part that is adapted to fit into the particular tray.

There are a number of features that may be incorporated into box 10 to make it easier to use in certain circumstances. For example, hinge 18 may have a central portion 56 that is magnetic. Magnetic central portion 56 may be used as a quick catcher for tools or tool parts, as best seen in the embodiment shown in FIG. 4. Box 10 may also include a detachable strap 58. Box 10 may be provided with a retractable handle 60 so that it can easily be retracted to ease storage and minimize obstruction. Box 10 may be provided with a magnetic lock 62.

Figure 3:
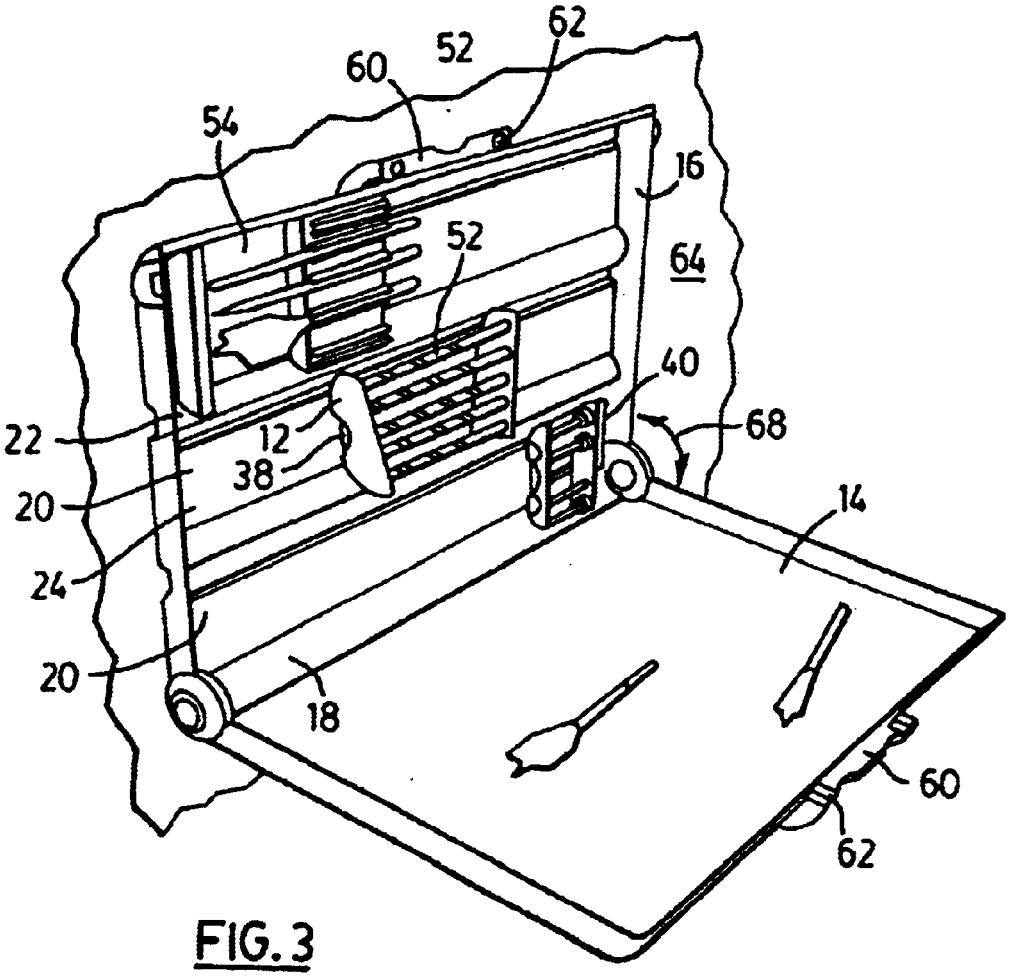
FIG. 3 is a perspective view of the present invention showing the tool box attached to a wall.

Preferably box 10 is attachable to a wall 64 as shown in FIG. 3. Box 10 may be provided with base magnets 66 (shown in FIG. 2) which are attachable to a metal portion (not shown) on a wall 64. Lid 14 is arranged such that when base 16 is attached to a wall the angle 68 formed between the lid 14 and the base 16 is generally between 90° and 115° and is preferably about 100°. Referring to FIG. 2, the inner hinge edge 70 of lid 14 will bear against metal portion 24 when the lid is in the open position. When base 16 of box 10 is attached to wall 64 and lid 14 is in the open position, lid 14 acts as a handy shelf.

Figure 5:
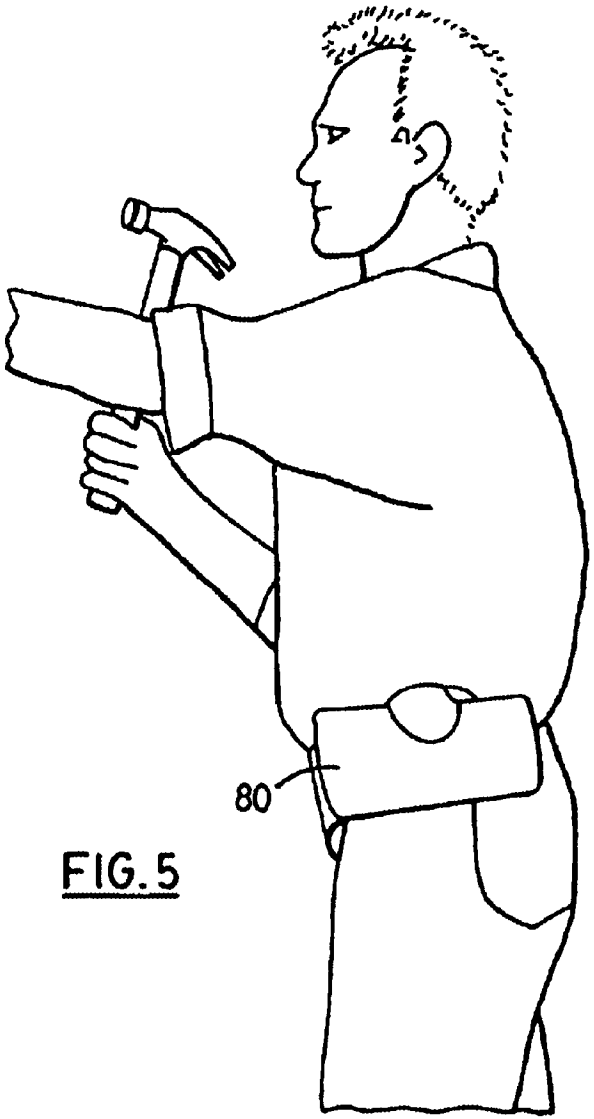
FIG. 5 is a perspective view of the embodiment of tool box of FIG. 4 shown attached to a user's belt.
Figure 4:
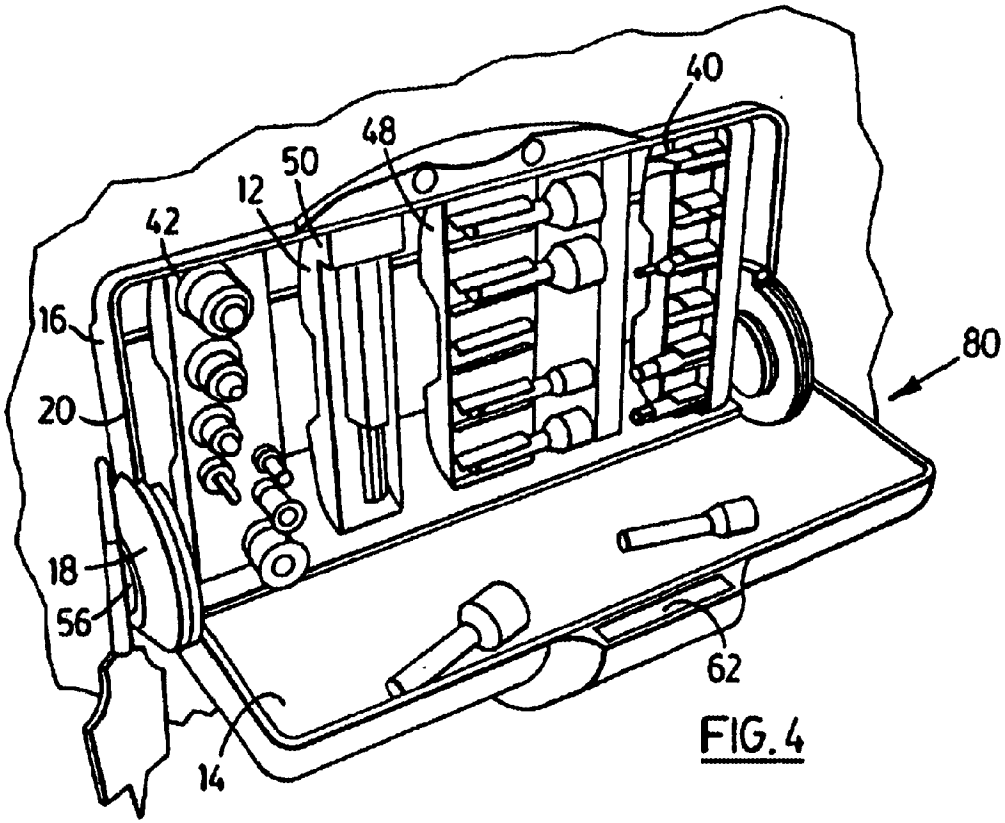
FIG. 4 is a perspective view of an alternate embodiment of the tool box of the present invention.

Referring to FIGS. 4 and 5 a smaller embodiment of the tool box is shown generally at 80. The small tool box 80 is generally the same as tool box 10 but it holds a more limited number of trays 12 and it has only one row 20. The small tool box 80 is sized to be easily carried or clipped onto the user's belt as shown in FIG. 5. It will be appreciated by those skilled in the art that the small tool box 80 may be constructed in a variety of sizes. For example the small tool box may be 12 inches long by 5 inches wide by 2 inches deep.

Figure 6:
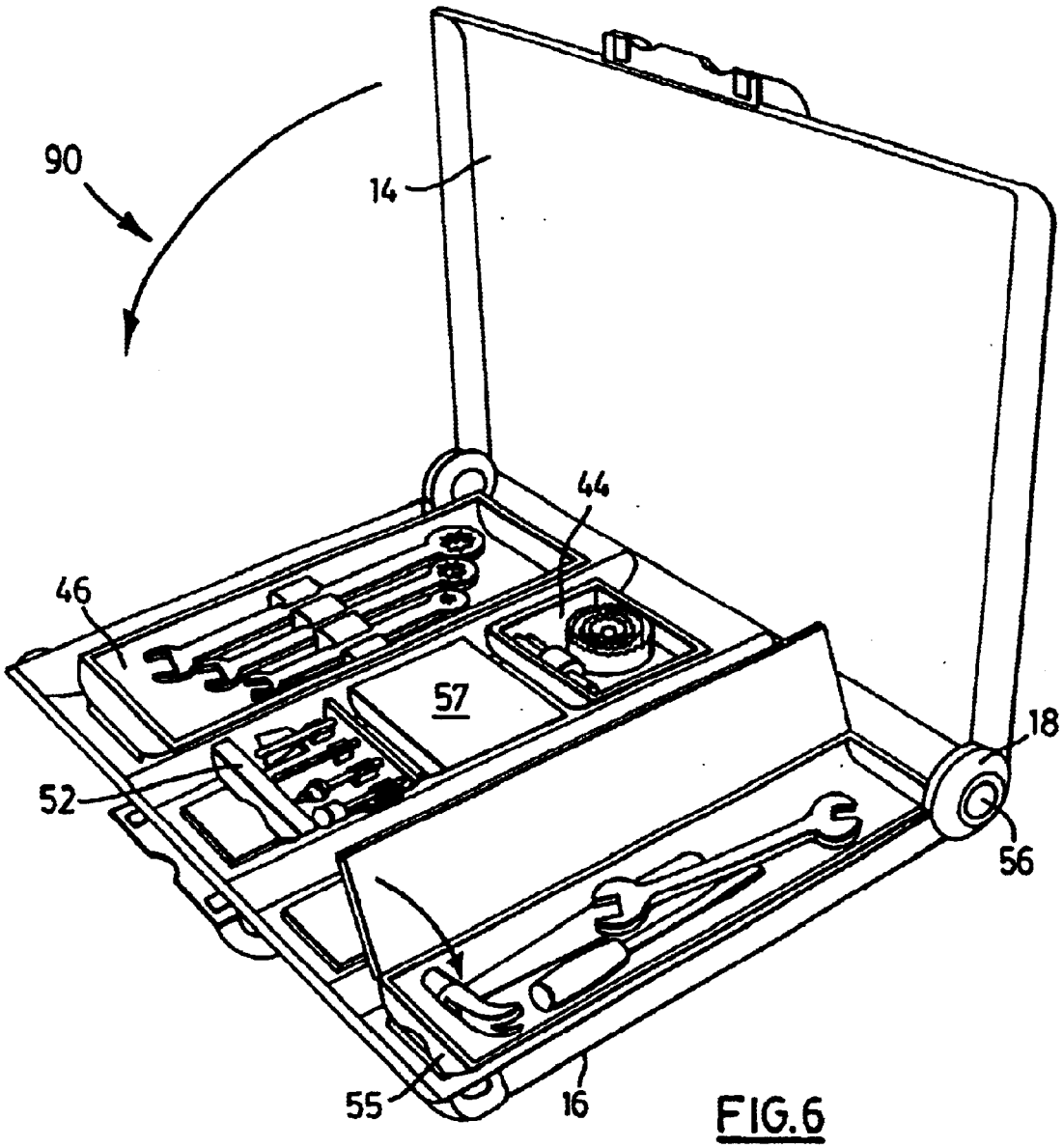
FIG. 6 is a perspective view of a second alternate embodiment of the tool box of the present invention but showing width-wise rows.

Referring to FIG. 6, an alternate embodiment of the tool box is shown generally at 90. Tool box 90 is similar to tool box 10 but it has width-wise rows 92 rather than the length-wise rows 20 of box 10.

The lid 14, base 16, hinge 18 and tray 12 of the tool box 10, 80 are preferably injection molded. The base 16, hinge 18 and tray 12 may be made from ABS plastic, polypropylene and/or polyethylene and the transparent lid 14 from acrylic. All but the retractable handle and the lid are injection molded ABS, polypropylene and/or polyethylene. The lid 14 and the base 16 are connected by a pair of pivot hinges 18 in which a magnet 56 is housed and to be used as a magnetic catcher. Each metal portion 24 is preferably a brushed steel plate that is attached to the bottom of each row 20 of the box 10, 80. The retractable handle 60 is preferably made of injection molded rubber ABS, polypropylene and/or polyethylene.

There are a number of advantages that may be realized with the tool box 10, 80 of the present invention. The tool box is easy to use with a wide variety of tools and tool parts. If the user is working on a project that requires a variety of different sized drill bits but no other tools the user can easily take that one tray to the project. Further, the user may arrange the tools in the tool box to suit his/her own work routine rather than a tool box that tries to force the maximum number of tools into the minimum sized box with little of an eye to functionality or usability.

It will be appreciated that the above description related to the invention by way of example only. Many variations on the invention will be obvious to those skilled in the art and such obvious variations are within the scope of the invention as described herein whether or not expressly described.

What is claimed as the invention is:

1. A tool box for holding a plurality of tools and tool parts comprising:

a base having a plurality of elongate rows, each row being separated by elongate curved ridges on opposite sides thereof and a width and each of the plurality of rows generally having the same width;

a lid attachable to the base;

a plurality of trays, each tray having at least one receiving device for retaining a predetermined tool and each tray having a width that generally corresponds to the width of each row and opposite curved sides configured to cooperatively seat with and between two adjacent ridges to thereby position each tray relative to said rows, and the trays being of a size such that more than one tray is positionable in one of the plurality of rows; and magnetic means in each row for releasably securing the plurality of trays within said rows and intermediate said ridges.

2. A tool box as claimed in claim 1 wherein the magnetic means includes an elongate metal plate attached to a bottom of the row and magnets attached to bottoms of the trays.

3. A tool box as claimed in claim 1 wherein each tray has a finger recess on opposite ends thereof.

4. A tool box as claimed in claim 1 further including a storage box tray having a storage box tray lid attachable to the storage box tray and the storage box tray being releaseably secured to each row.

5. A tool box as claimed in claim 1 further including a retractable handle.

6. A tool box as claimed in claim 1 further including a magnetic lock.

7. A tool box as claimed in claim 1 further including a releaseably attachable carrying strap.

8. A tool box as claimed in claim 1 wherein the lid is pivotally attached to the base and has an open and a closed position and in the open position an angle between the lid and the base is generally between 90° and 115°.

9. A tool box as claimed in claim 8 wherein the angle is 110°.

10. The tool box of claim 1 including hinge means for pivotally connecting the lid to the base, and each hinge including a magnetic portion for securing a tool thereto.

11. The tool box of claim 1 including magnetic means carried by the base for mounting the base to a vertical metallic support.

* * * * *